United States Patent [19]

Anderson

[11] Patent Number: 4,759,524

[45] Date of Patent: Jul. 26, 1988

[54] COASTER

[76] Inventor: Jack E. Anderson, 26 Marlborough, Bloomfield Hills, Mich. 48013

[21] Appl. No.: 946,665

[22] Filed: Dec. 31, 1986

Related U.S. Application Data

[63] Continuation of Ser. No. 761,001, Jul. 31, 1985, abandoned.

[51] Int. Cl.[4] ..... A47B 43/04

[52] U.S. Cl. ..... 248/346.1; 215/100.5; D7/45

[58] Field of Search ..... 248/346.1; 215/100.5; D7/45

[56] References Cited

U.S. PATENT DOCUMENTS

| | | | |
|---|---|---|---|
| D. 91,501 | 2/1934 | Roe . | |
| D. 132,808 | 11/1872 | Currier . | |
| D. 151,449 | 10/1948 | Jenkins | D7/45 |
| D. 158,981 | 6/1950 | Levine . | |
| D. 189,791 | 2/1961 | Fitzgerald | D7/45 |
| D. 245,384 | 8/1977 | Ashton . | |
| 1,915,214 | 6/1933 | Caldwell . | |
| 1,981,627 | 11/1934 | Merriman . | |
| 2,206,694 | 7/1940 | Greene . | |
| 3,583,664 | 6/1971 | Kallina . | |

*Primary Examiner*—David L. Talbott
*Attorney, Agent, or Firm*—Brooks & Kushman

[57] ABSTRACT

This invention is concerned with a coaster for drinking cups comprising:

a circular wall section;

a base section enclosed within said wall section;

a first rim means projecting upwardly from the base section and extending from the wall section toward the center of the coaster;

a second rim means shorter in length than, but equal in height to, the first rib means, the second rim means projecting upwardly from the base and extending from the wall section towards the center of the coaster;

the first and second rib means positioned so that a cup placed within the coaster may contact the top portion of each upwardly projecting rib means;

the first and second rib means being separated an effective droplet removing distance from each other at a point approximately where both rib means contact the wall section.

By appropriately spacing the rib means, condensation droplets that are formed on a drinking cup can conveniently pass from the cup into the coaster.

5 Claims, 2 Drawing Sheets

COASTER

This application is a continuation of Ser. No. 06/761,001 filed July 31, 1985, now abandoned.

BACKGROUND OF THE INVENTION

The present invention is concerned with coasters, and in particular, coasters that can be utilized for a significant period of time with a drinking cup therein which facilitates removal of liquid droplets which condense on the side of the drinking cup.

U.S. Pat. No. Des. 91,501 shows a coaster having ribbed sections in the design of a star. The rib sections emanate from the periphery of the circular coaster and dwell towards the center. The center portion is a locale for insertion of the bottom of a cup.

U.S. Pat. No. Des. 132,808 shows a pitcher holder with a singular set of ribs emanating from the circular periphery of the holder towards the center.

U.S. Pat. No. Des. 158,981 teaches a coaster or similar design where the supporting ribs do not touch the periphery nor extend directly into the center of the coaster.

U.S. Pat. No. Des. 254,384 shows a combined coaster and cover where a plurality of ribs are shown, all of which extend equidistant from the circumference of the coaster towards the center.

U.S. Pat. No. 1,915,214 teaches a combination ash receiver and beverage container support. Note that the ribs do extend from the periphery of the support towards the center. There are dissimilar distances from the ribs 2, dissimilar to the extent that they have different lengths from the periphery towards the center. Note FIGS. 2 and 3 indicate that the ribs are webs or flanges 3 which have their upper edges sloping inwardly of the compartment from the inner wall 5.

U.S. Pat. No. 1,981,627 teaches a coaster where the ribs do not touch the exterior circular wall 8. The coasters do appear to be stackable.

U.S. Pat. 2,206,694 teaches a flowerpot saucer with a variety of short ribs 8, 9, and 10 tapered in vertical thickness from their ends nearr the center of the saucer towards the outer ends as shown in FIG. 1.

U.S. Pat. No. 3,583,664 teaches an anti-drip saucer for coffee cups, has a center disk-like base formed inwardly with the lower inner edges of the collar and a plurality of ribs projecting upwardly from the base and terminating below the upper edge of the collar for supporting the lower edge of the coffee cup.

Each of the prior art references suffer from the capability of having a coster which would facilitate the removal of condensed droplets on the drinking cup. Further, the coaster of the present invention permits the utilization of a drinking cup with condensed droplets thereon for a significant period of time without sufficent overflowing of the condensation in the coaster.

SUMMARY OF THE INVENTION

The present invention is concerned with a coaster for drinking cups comprising:

a circular wall section;

a base section enclosed within said wall section;

a first rib means projecting upwardly from the base section and extending from the wall section toward the center of the coaster;

a second rib means shorter in length than, but equal in height to, the first rib means, the second rib means projecting upwardly from the base and extending from the wall section towards the center of the coaster;

the first and second rib means positioned so that a cup placed within the coaster may contact the top portion of each upwardly projecting rib means;

the first and second rib means being separated an effective droplet removing distance from each other at a point approximately where both rib means contact the wall section.

DESCRIPTION OF PREFERRED EMBODIMENTS

The present invention is concerned with a coaster which facilitates the removal of droplets that condense on a drinking cup during standing. It is well-known that a drinking cup will form droplets of condensation thereon during standing. In high-humidity environments, a cool drinking cup such as one that has ice therein has a tendency to form droplets of condensation on the exterior on the drinking cup.

One of life's annoyances is the dripping that comes from a cool glass in humid environmental conditions onto one's clothing. The coaster of the present invention is designed to alleviate such annoyances.

Figure 1:
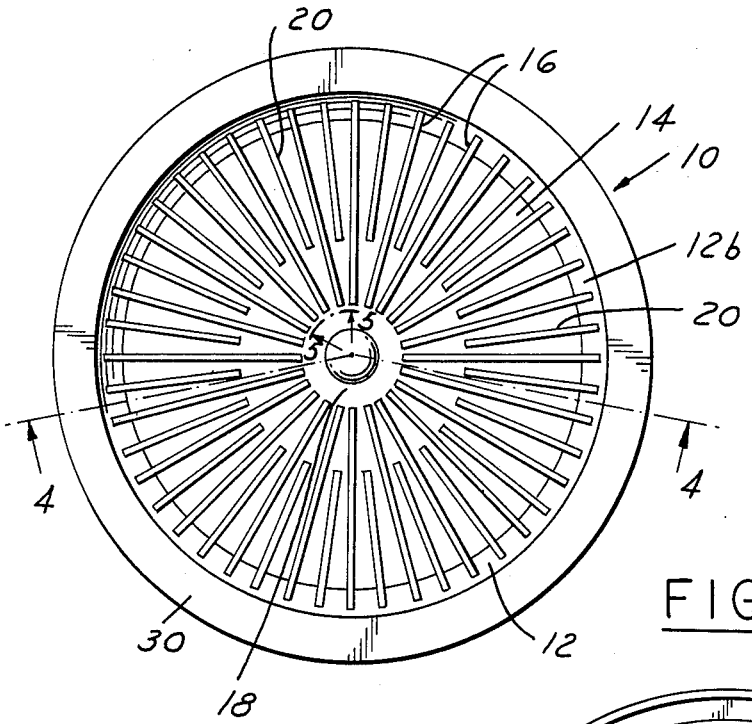
FIG. 1 is a top view of the coaster of the present invention.
Figure 2:
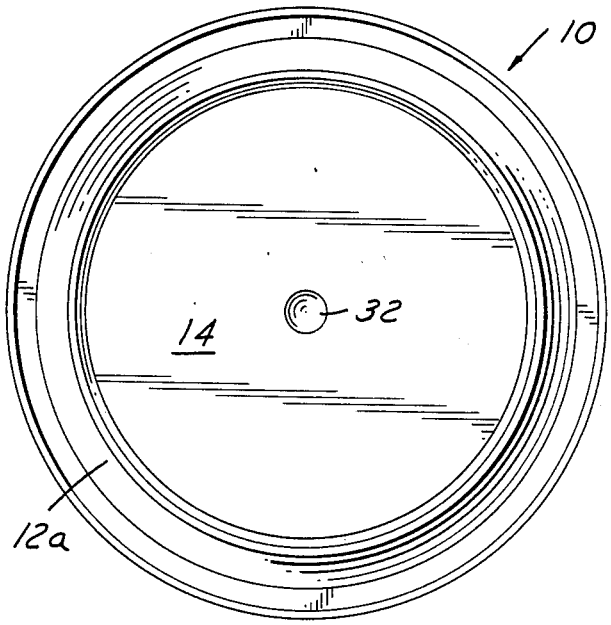
FIG. 2 is a bottom view of the coaster of the present invention.
Figure 3:
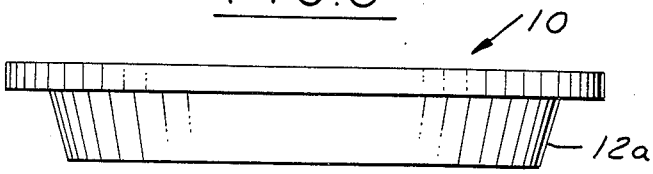
FIG. 3 is a side view of the coaster of the present invention.
Figure 4:
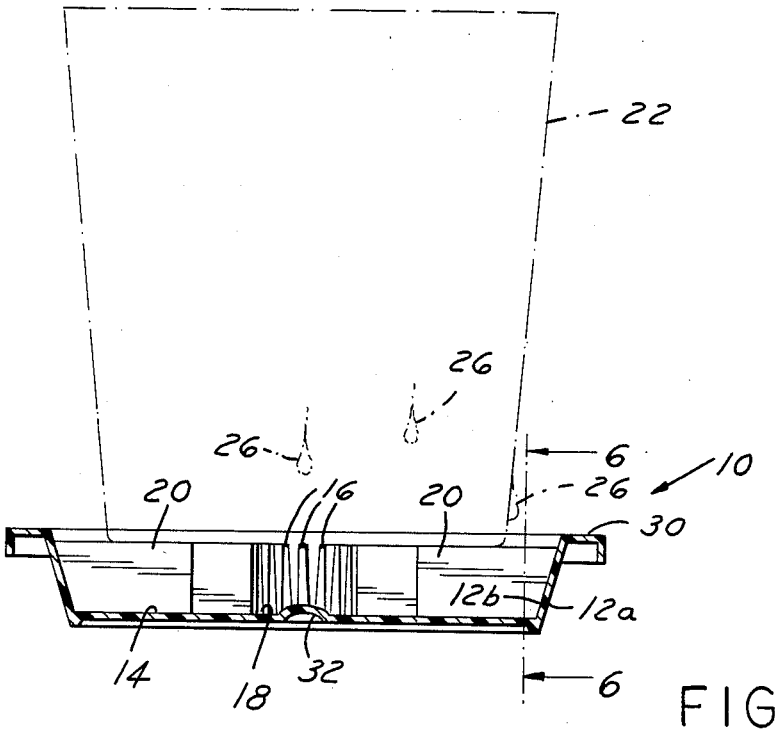
FIG. 4 is a sectional view taken along lines 4—4 of FIG. 1 with the outline of a cup therein.
Figure 6:
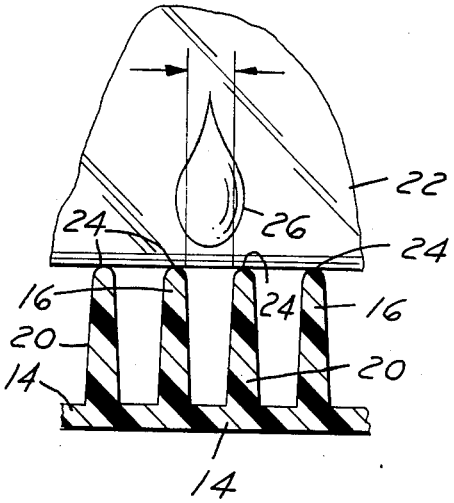
FIG. 6 is a sectional view taken along lines 6—6 of FIG. 4.
Figure 5:
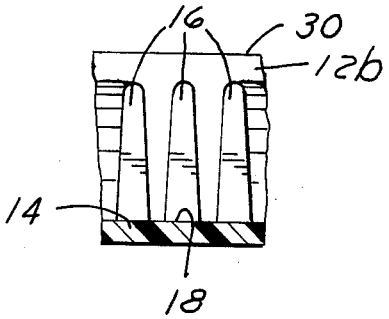
FIG. 5 is a sectional view taken along lines 5—5 of FIG. 1.

In FIG. 1 the top view of the coaster 10 of the present invention is described and shown. The coaster is comprised of a wall section 12 having an outer portion **12*a* and an inner portion 12*b* The wall is disposed at a minor angle from the vertical axis as best shown in FIG. 4. By minor angle is meant a 45° angle or less from the vertical. Enclosed within the interior of the wall section is a base section 14. Unique to this present invention is a plurality of rib means. A first rib means 16 projects upwardly from the base and extends from the wall section 14 towards the center of the coaster, generally described with reference numeral 18. A second rib means 20 is comprised of a plurality of members that are shorter in length than the first rib section. The second rib means is equal in height to the first rib means. The purpose of the rib means being equivalent in height, best shown in FIGS. 5 and 6, is to permit the cup 22, outline of which is shown in FIG. 4 to neatly rest atop the upstanding first and second rib sections or means. The drinking cup sits atop the first and second rib sections thereby contacting the sections at respective points 24. As can be seen in FIG. 1, the first rib section 16 extends from the wall section towards the center and is approximately 50 percent longer than the second rib means 20**.

The droplets 26 that form during in a humid environment when the cup is cool has a tendency by force of gravity to flow to the bottom portion of the drinking cup. The height of the ribs should be of a sufficent size to permit a drinking cup to be utilized for a half-hour to an hour without the rib sections being filled with condensate from the drinking cup. Generally this height can be upwards of ½ inch (1.27 cm.) although it has been perferred be approximately ⅜ inch (0.95 cm.).

As can be seen in FIG. 6, the droplet size somewhat dictates the distance between the ribs themselves. Generally droplets are approximately ¼ inch (0.635 cm.) in size and therefore the first and second ribs should be spaced at an effective droplet removing distance from each other at the point approximately where both rib means contact the wall section. It has been found desirable that the ribs are spaced at the wall member approximately ¼ inch (0.635 cm.) but may be of a range upwards of ½ inch (1.27 cm.). Other sizes above and below may be utilized such as about ⅛ inch (0.3175 cm.) to about ½ inch depending upon manufacturing conditions necessary for the coaster or for some particular environment in which the drinking cup may be utilized where a droplet larger than that described above would be formed.

The ribs themselves are radiused at the tops thereof namely at point 24 that comes in contact with the drinking cup. This facilitates the removal of the droplet from the cup to the coaster itself. If the ribs were flat at the top, there may be an increase in surface tension and therefore decrease the ability of the coaster to remove the droplet from the cup. Surface tension will be of such an extend that the droplet will remain on the cup; and therefore, drip onto one's clothing when the cup is raised.

By the droplet on the drinking cup contacting the rib, the cohesive force between the cup and the droplet is broken, thereby allowing the droplet to flow from the cup to the coaster down the rib.

While variations may be made on the size of the width of the ribs, it has been found that they should be approximately 0.04 inch (0.1 cm.) wide.

The coaster itself may be formed of any material that can be conveniently fashioned to appropriately size the rib sections, with the necessary distance apart, height, and radius as indicated above. The coaster may be comprised of crockery, china, porcelain, but most preferably of a plastic or metal nature. Due to the cost advantage, it would be preferred that the coaster be comprised of a plastic such as polyethylene, polypropylene, polybutylene, polyvinyl chloride, polystyrene, acrylonitrile-butadiene-styrene (ABS), and the like, most preferably polystyrene or polypropylene. While the various sizes for the ribs and distances between same have been discussed above, it is to be appreciated that normal manufacturing tolerences can be utilized to produce the coaster.

In general, the coaster is prepared by injection molding, although other molding techniques may be utilized such as blow molding or casting and the like. Other manufacturing techniques could likewise be utilized, to achieve the most efficient technique for manufacturing on a cost-efficient basis. The first ribs 20 converge to center portion 34 and in general are arranged thereat that the condensed water will flow through the center such as by having the ribs separated by about 0.060 inch (0.15 cm.) at the top thereof (See FIG. 5). The size of the coaster can widely vary with a perferred outer dimension length of base 14 preferably being about 3 inches (7.62 cm).

It will be understood, of course, that while the form of the invention herein shown and described constitutes a preferred embodiment of the invention,it is not intended to illustrate all possible forms of the invention. It will also be understood that the words used are words of description rather than of limitation and that various changes may be made without departing from the spirit or scope of the invention disclosed. For example, the lip or flange 30 can be formed in any convenient fashion. It may be desirable to extend the lip to permit increased stackability of the coasters. In addition, the dimple 32 that occurs at the bottom portion of the base section may be modified depending upon the manufacturing technique utilized for forming the coaster herein described. Also, additive features such as felt or rubber pads could be placed on the bottom to decrease sliding of the coaster.

What is claimed is:

1. A coaster for a drinking cup, said coaster comprising:

a circular walled section;

a base section enclosed within said wall section;

a plurality of first ribs having a height projecting upwardly from the base section and a length extending from the wall section toward the center of the coaster;

a plurality of second ribs projecting upwardly from the base section and having a height equal to that of said first ribs and a length extending from the wall section toward the center, said length being shorter than that of said first ribs;

said first and second ribs being alternatively positioned from one another in a spaced apart manner and having an upper surface lying along a common plane so that a cup placed within the coaster will contact the upper surface of each rib, said ribs being separated from one another in effective droplet removing distance of about ¼ inch at the point approximately where adjacent ribs contact said wall sections so that the ribs will effectively contact any condensate droplets forming on the cup thereby breaking the adhesive force between the cup and said condensate droplets allowing the condensate droplets to flow from the cup down the rib into the coaster base sesction.

2. The coaster of claim 1 wherein the center portion is comprised of an area where the first rib means are extended thereto but do not meet and are spaced so the droplets that are collected from the drinking cup do pass into the center of the coaster.

3. The coaster of claim 1 where the wall section is formed at a minor angle from a vertical axis perpendicular to the base section.

4. The coaster of claim 3 wherein the minor angle is equal to or less than 45° from the vertical axis.

5. The coaster of claim 1 wherein the ribs are approximately ⅜ inch (0.95 cm.) in height.

* * * * *